US009520666B2

(12) United States Patent
Hagemeier et al.

(10) Patent No.: US 9,520,666 B2
(45) Date of Patent: Dec. 13, 2016

(54) CONTACT CARRIER WITH A TOLERANCE-COMPENSATING PORTION

(71) Applicant: PHOENIX CONTACT GMBH & CO KG, Blomberg (DE)

(72) Inventors: Willi Hagemeier, Schieder-Schwalenberg (DE); Falk Langer, Zwonitz (DE)

(73) Assignee: PHOENIX CONTACT GMBH & CO KG, Blomberg (DE)

( * ) Notice: Subject to any disclaimer, the term of this patent is extended or adjusted under 35 U.S.C. 154(b) by 0 days.

(21) Appl. No.: 14/766,030

(22) PCT Filed: Feb. 6, 2014

(86) PCT No.: PCT/EP2014/052306

§ 371 (c)(1),
(2) Date: Aug. 5, 2015

(87) PCT Pub. No.: WO2014/127999

PCT Pub. Date: Aug. 28, 2014

(65) Prior Publication Data

US 2015/0372409 A1 Dec. 24, 2015

(30) Foreign Application Priority Data

Feb. 25, 2013 (DE) ..... 10 2013 101 823

(51) Int. Cl.
*H01R 13/40* (2006.01)
*H01R 13/42* (2006.01)
(Continued)

(52) U.S. Cl.
CPC ..... *H01R 13/42* (2013.01); *H01R 12/57* (2013.01); *H01R 13/5202* (2013.01); *H01R 43/0256* (2013.01)

(58) Field of Classification Search
CPC ..... H01R 13/42; H01R 13/5202; H01R 12/57; H01R 43/0256; H01R 9/226; H05K 7/026; H01H 9/10
(Continued)

(56) References Cited

U.S. PATENT DOCUMENTS 6,220,874 B1 * 4/2001 Kurata ..... B60R 16/0207 439/76.2
7,077,667 B2 * 7/2006 Maebashi ..... H01H 9/10 439/76.2
(Continued)

FOREIGN PATENT DOCUMENTS

DE 10 2006 052 119 A1 5/2008
DE 10 2009 026 816 A1 12/2010
EP 2 639 894 A1 9/2013

OTHER PUBLICATIONS

International Search Report (PCT/ISA/210) mailed on Mar. 13, 2014, by the European Patent Office as the International Searching Authority for International Application No. PCT/EP2014/052306.
(Continued)

*Primary Examiner* — Jean F Duverne
(74) *Attorney, Agent, or Firm* — Buchanan Ingersoll & Rooney PC

(57) ABSTRACT

The disclosure relates to a contact carrier including an electrical contact and a contact arm which is connected to the electrical contact in an electrically conducting manner. The contact arm includes a tolerance-compensating portion and a contact base formed on the tolerance-compensating portion for electrically contacting the electrical contact with a contact surface.

18 Claims, 8 Drawing Sheets

(51) Int. Cl.
*H01R 12/57* (2011.01)
*H01R 43/02* (2006.01)
*H01R 13/52* (2006.01)

(58) Field of Classification Search
USPC ..... 439/733.1
See application file for complete search history.

(56) References Cited

U.S. PATENT DOCUMENTS

| | | | | |
|---|---|---|---|---|
| 8,378,235 | B2 * | 2/2013 | Matsui | H05K 7/026 174/541 |
| 2005/0032402 | A1 | 2/2005 | Takanashi et al. | |
| 2007/0010112 | A1 * | 1/2007 | Makino | H01R 9/226 439/76.2 |
| 2010/0285686 | A1 | 11/2010 | Lang et al. | |
| 2012/0080626 | A1 | 4/2012 | Fuerst | |
| 2013/0237070 | A1 | 9/2013 | Wehrle et al. | |

OTHER PUBLICATIONS

Office Action issued Dec. 19, 2013 by the German Patent Office in corresponding German Patent Application No. 10 2013 101 823.8 (7 pages).

* cited by examiner

CONTACT CARRIER WITH A TOLERANCE-COMPENSATING PORTION

The invention relates to a contact carrier having an electrical contact and having a contact arm which is electrically conductively connected to the electrical contact.

Contact carriers of this kind are used in order to establish an electrically conductive connection between the electrical contact and a printed circuit board. The electrical contact can be configured, for example, as a socket or plug. In the case of through-hole technology (THT), wire connections of the contact carrier are inserted through contact holes in the printed circuit board and then electrically conductively connected to conductor tracks on the printed circuit board by soldering (for example conventional hand soldering, wave soldering or selective soldering). In the case of surface-mounting technology (SMT), however, connection surfaces of the contact carrier which can be soldered are soldered directly onto the conductor tracks of the printed circuit board. To this end, the conductor track portions on the printed circuit board, which serve as connection surfaces, are printed, for example by means of screen or stencil printing, with solder paste before components are mounted. After the contact carrier is mounted, the connection surfaces are soldered to one another in order to electrically conductively connect said connection surfaces. If the contact carrier is arranged on a top face of the printed circuit board, reflow soldering can be used for example. If, in contrast, the contact carrier is arranged the bottom face of the printed circuit board, said contact carrier is adhesively bonded and soldered in the wave or splash bath. Therefore, components can be mounted very densely and primarily on both faces of the printed circuit board, this reducing the space requirement. As a result, electrical devices can be manufactured to be small and at the same time significantly more cost effective.

However, so-called blurring can occur during soldering. On account of the blurring, the contact carrier is not located in the desired position on the printed circuit board after soldering, but rather the contact carrier is displaced, for example, in the X and Y direction. Furthermore, a fault can also occur in the rotation angle of the contact carrier. In this case, the contact carrier has rotated about its own vertical axis. The four following cases can result as fault patterns depending on the displacement and rotation of the contact carrier:

- The contact carrier is electrically connected, is not situated exactly in the middle, but is located with its entire connection metalization above the printed circuit board.
- The contact carrier is electrically connected but projects beyond a copper surface of the printed circuit board by way of its connection metalization.
- The contact carrier is not electrically connected and projects beyond the copper surface of the printed circuit board by way of its connection metalization.
- The contact carrier is not electrically connected and is situated entirely outside the copper surface of the printed circuit board by way of its connection metalization.

The object of the present invention is therefore to provide an improved contact carrier.

This object is achieved by the subject matter having the features according to the independent claim. Advantageous embodiments are the subject matter of the dependent claims, the description and the drawings.

The present invention is based on the knowledge that the faulty positioning which is caused by the blurring can be compensated for by tolerance compensation.

According to a first aspect, the object is achieved in that the contact carrier has an electrical contact and a contact arm which is electrically conductively connected to the electrical contact, wherein the contact arm comprises a tolerance-compensating portion and a contact, which is formed on the tolerance-compensating portion, for electrically contacting the electrical contact with a contact surface. This results in the technical advantage that the tolerance-compensating portion compensates for faulty positioning due to blurring. The manufacturing yield is increased in this way.

In one advantageous embodiment, the contact arm extends laterally or radially from the electrical contact. This results in the technical advantage that the contact carrier has compact dimensions and therefore takes up only a small amount of installation space.

In a further advantageous embodiment, the electrical contact extends in a first direction, and the contact arm extends in a second direction, wherein the first direction and the second direction are arranged at an angle, in particular at an angle of 90° C., within an angle within an angle tolerance range. In this case, the angle tolerance range can have manufacturing-related tolerances and be, for example, 5%, 10% or 15% of, for example, 90°. This results in the technical advantage that the contact carrier is particularly simple to manufacture.

In a further advantageous embodiment, the contact base extends in the second direction within an angle tolerance range. In this case, the angle tolerance range can have manufacturing-related tolerances and be, for example, 5%, 10% or 15%. This results in the technical advantage that the contact carrier can be of even more compact design and therefore even less installation space is taken up.

In a further advantageous embodiment, the tolerance-compensating portion is mechanically deformable. This results in the technical advantage that the tolerance-compensating portion can be deformed by forces which occur during soldering and can compensate for said forces.

In a further advantageous embodiment, the tolerance-compensating portion is elastically or plastically deformable. This results in the technical advantage that deformation which occurs only during soldering on account of thermally induced stresses can be compensated for owing to elastic deformability, while permanent faulty positioning can be compensated for owing to the plastic deformability.

In a further advantageous embodiment, the contact base is connected to the electrical contact by means of the tolerance-compensating portion. This results in the technical advantage that the tolerance-compensating portion is arranged between the contact footcontact base and the electrical contact. Therefore, the contact carrier has a particularly simple design.

In a further advantageous embodiment, the tolerance-compensating portion comprises a bent arc, in particular a U-shaped bend. This results in the technical advantage that, together with a compact construction, a tolerance-compensating portion for compensating large tolerances is provided, said tolerance-compensating portion being simple to manufacture.

In a further advantageous embodiment, the contact base is arranged on the tolerance-compensating portion angled at an angle. This results in the technical advantage that, owing to the angled arrangement of the tolerance-compensating portion on the contact base, the tolerance-compensating portion can be particularly easily deformed at this point, in order to compensate for tolerances.

In a further advantageous embodiment, the contact base is arranged below the tolerance-compensating portion. This results in the technical advantage that the contact carrier can be fastened in a particularly simple manner with the contact base on a contact surface, such as a conductor track of a printed circuit board for example.

In a further advantageous embodiment, the contact base is formed on the tolerance-compensating portion in an elastically or plastically deformable manner. This results in the technical advantage that deformation which occurs only during soldering on account of thermally induced stresses can be compensated for owing to elastic deformability, while permanent faulty positioning can be compensated for owing to the plastic deformability.

In a further advantageous embodiment, the contact base is a solder pad base. This results in the technical advantage that a soldered connection can be formed with the contact base without problems.

In a further advantageous embodiment, the electrical contact is a contact socket or a contact plug. This results in the technical advantage that the contact sockets or contact plugs can be positioned on a printed circuit board without faults and the electrical contacts of said contact sockets or contact plugs can be electrically conductively connected to said printed circuit board.

In a further advantageous embodiment, the contact has a bottom part in which the electrical contact is held. This results in the technical advantage that the contact carrier is positioned on the electrical contact during soldering.

In a further advantageous embodiment, the bottom part has a radial recess for receiving the contact arm. This results in the technical advantage that the recess ensures positioning of the contact arm and therefore of the contact carrier.

In a further advantageous embodiment, the contact carrier has a removable insulating sleeve which is placed on the electrical contact. This results in the technical advantage that the insulating sleeve protects the electrical contact and at the same time a function identification can be associated with the electrical contact of the contact carrier by mechanical or optical coding.

In a further advantageous embodiment, the contact carrier has a plurality of electrical contacts which are each electrically conductively connected to a contact. This results in the technical advantage that a plurality of electrical contacts can be simultaneously formed at the same time.

In a further advantageous embodiment, the contact carrier is an SMD contact carrier (surface-mounted device). This results in the technical advantage that electrical contacts can be formed by machine by positioning and subsequent soldering in a furnace. Further exemplary embodiments are explained with reference to the appended drawings, in which.

Figure 1:
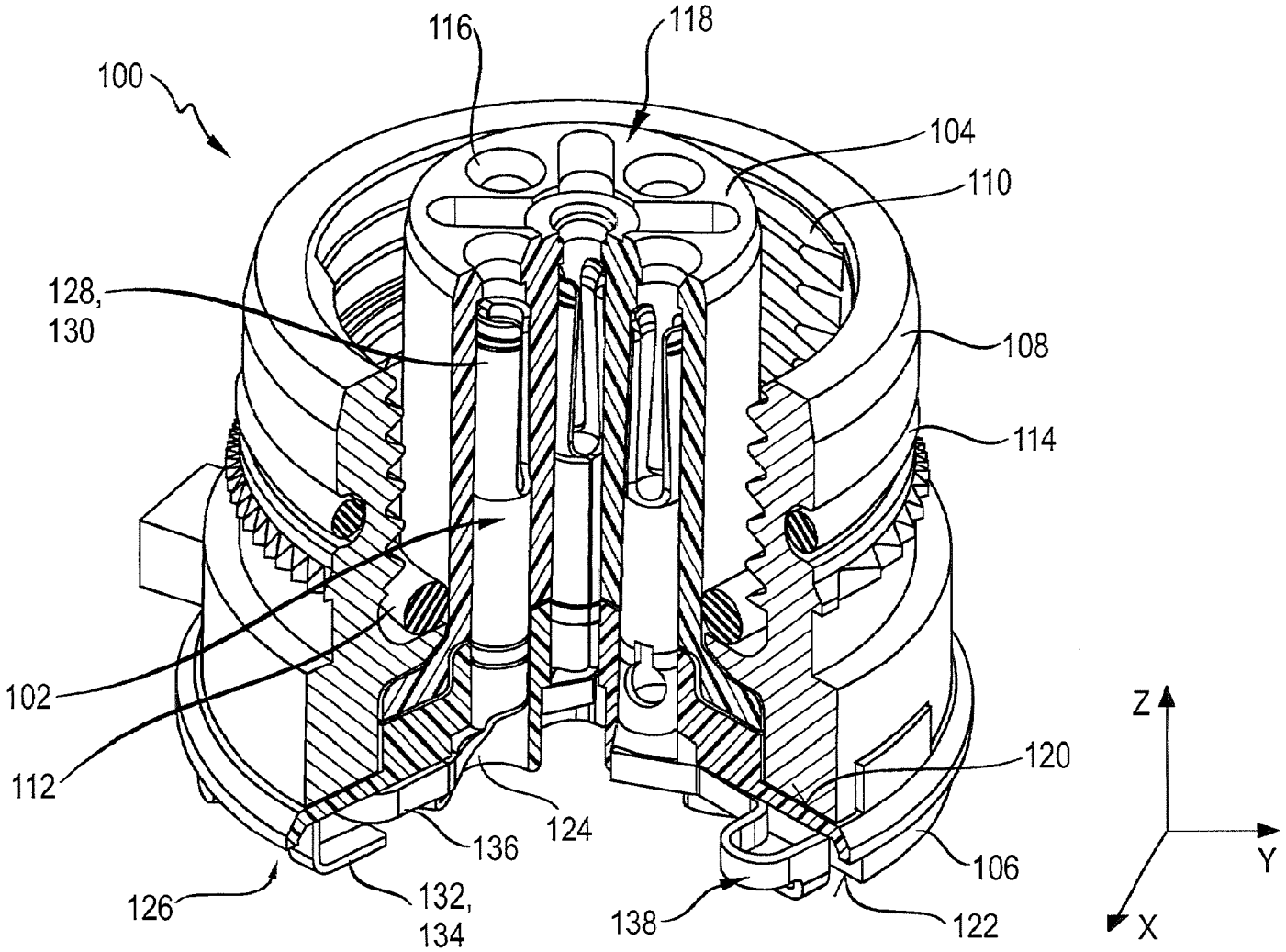
FIG. 1 shows a schematic illustration of a contact carrier.

FIG. 1 shows a contact carrier 100 which, in the present exemplary embodiment, comprises three contact pins 102, an insulating sleeve 104, a bottom part 106 and also a union nut 108. Only one of the three contact pins is identified by the reference symbol 102 in FIG. 1.

In the present exemplary embodiment, the contact carrier 100 is configured in order to form a socket for a socket/plug connection which can be fastened on a printed circuit board (not illustrated) by means of SMT technology. Therefore, the contact carrier 100 is configured as an SMD contact carrier (surface-mounted device) in the present exemplary embodiment.

In the present exemplary embodiment, the contact pin 102 is manufactured in one piece from metal, for example copper or a copper-containing alloy, for example by stamping and bending. The contact pin 102 has an electrical contact 128 which, in the present exemplary embodiment, is configured as a contact socket 130 and is therefore configured in order to receive an electrical pin contact (not illustrated) of a plug (not illustrated). Furthermore, the contact pin 102 has a contact base 132 which, in the present exemplary embodiment, is configured as a solder pad base 134 with which a soldered connection, which is known by means of SMT technology, for establishing an electrically conductive connection can be established with a contact surface, such as a conductor track of a printed circuit board for example. A contact arm 136 and a tolerance-compensating portion 138 are arranged between the contact base 132 and the electrical contact 128 or the contact socket 130.

In the present exemplary embodiment, the insulating sleeve 104 is manufactured from an electrically insulating material, for example a plastic material, for example by means of injection molding. Furthermore, the insulating sleeve 104 has a coding 118 which, in the present exemplary embodiment, is formed by a large number of depressions which form a mechanical coding in order to ensure a contact connection which is secured against polarity reversal. In the present exemplary embodiment, five passage channels 116 extend through the insulating sleeve 104, only one passage channel from amongst said five passage channels being identified by the reference symbol 116 in FIG. 1.

In the present exemplary embodiment, the bottom part 106 is manufactured from a high temperature-stable plastic, and therefore the bottom part 106 is not damaged or deformed during an SMT soldering process. In the present exemplary embodiment, the bottom part 106 has five passage openings 124, only one passage opening from amongst said five passage openings being identified by the reference symbol 124 in FIG. 1. In the present exemplary embodiment, in each case one of the passage openings 124 forms a passage with in each case one of the passage channels 116. Furthermore, the bottom part 106 has depressions 126 which are arranged on its bottom face 122, in each case one of said depressions being associated with one of the passage channels 116 and, in the present exemplary embodiment, extending radially.

FIG. 1 shows that the electrical contact socket 130 is located in the passage channel 116, while the contact arm 136 is received in the recess 126 which is formed on a bottom face 122 of the bottom part 106.

A union nut 108 is arranged on the top face 120 of the bottom part 106, said union nut having an internal thread 110 for establishing a screw connection to the plug. In the present invention, the union nut 108 further has an internal seal 112 and an external seal 114 for liquid-tight sealing.

The elastic or plastic deformability of the tolerance-compensating portion 138 ensures that the contact base 132 or solder pad base 134 can be moved in all three directions, that is to say in the X, Y and Z directions, in order to compensate for blurring during an SMT soldering process. The tolerance-compensating portion 138 can compensate for, for example, fault tolerances in a range of from 0.1 to 1 mm. In the present exemplary embodiment, the tolerance-compensating portion 138 allows fault tolerances of 0.5 mm to be compensated for.

Figure 2:
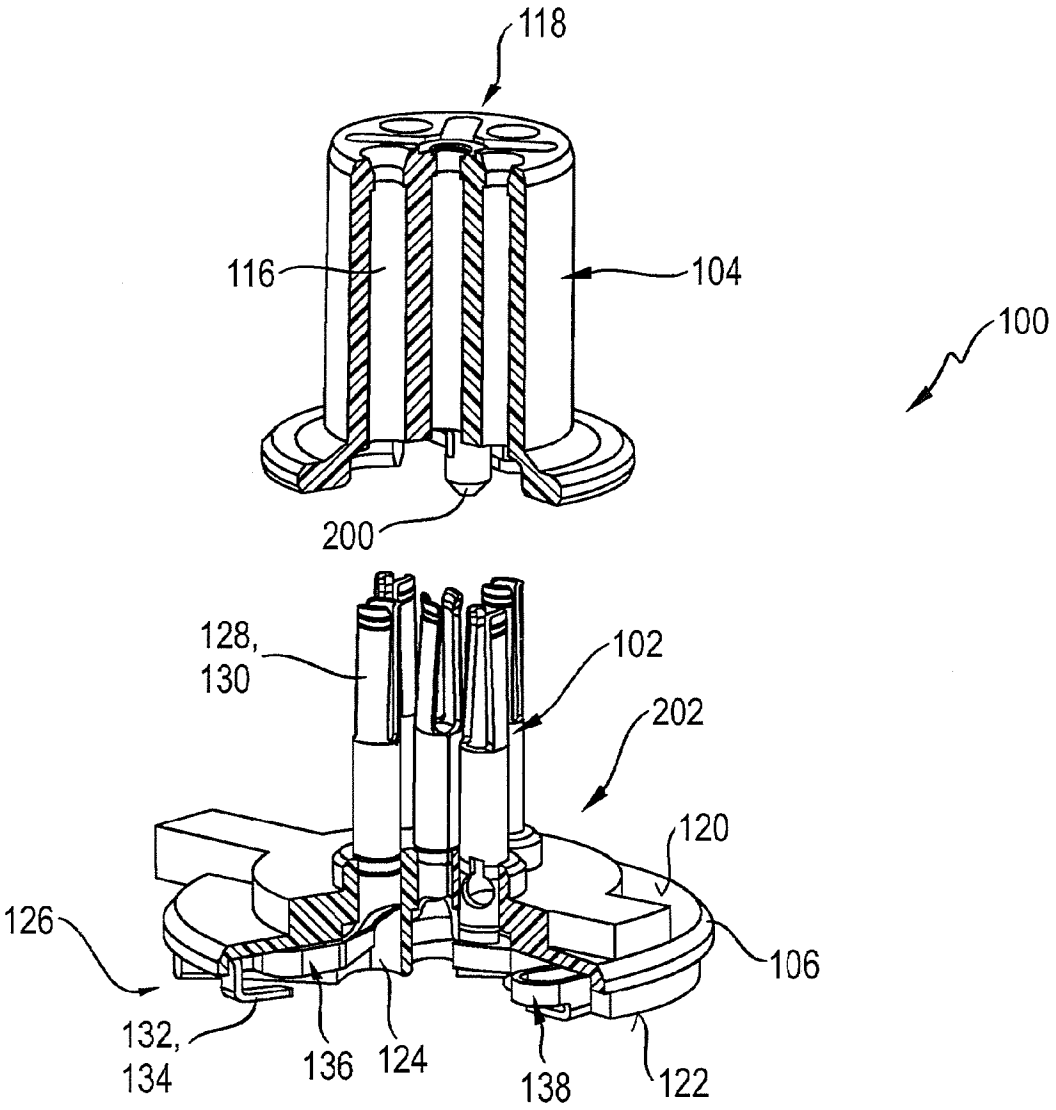
FIG. 2 shows an exploded view drawing of the contact carrier.

FIG. 2 shows an exploded view drawing of the contact carrier 100.

Said figure shows that the insulating sleeve 104 has positioning pegs 200 which engage into positioning holes 202 in the bottom part 106.

Figure 3:
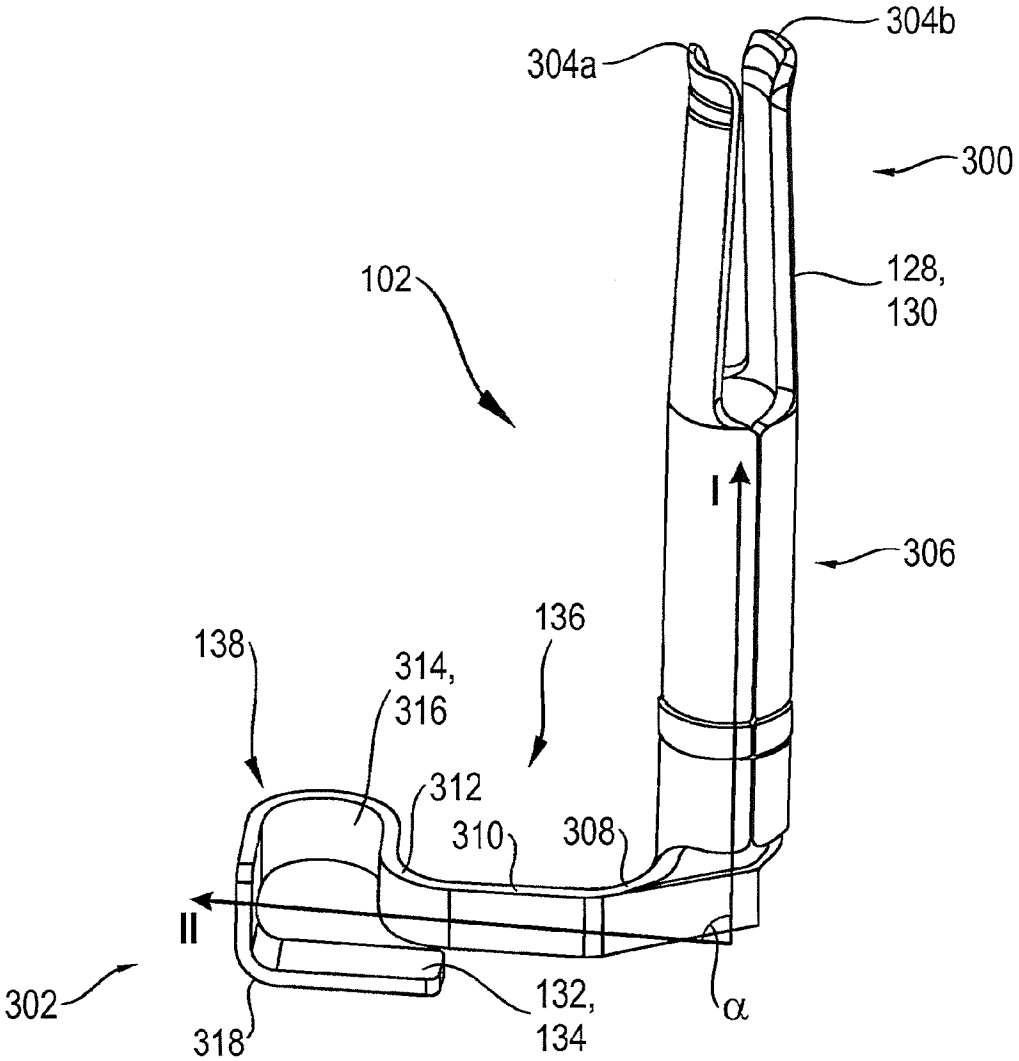
FIG. 3 shows a perspective illustration of a contact pin.
Figure 4:
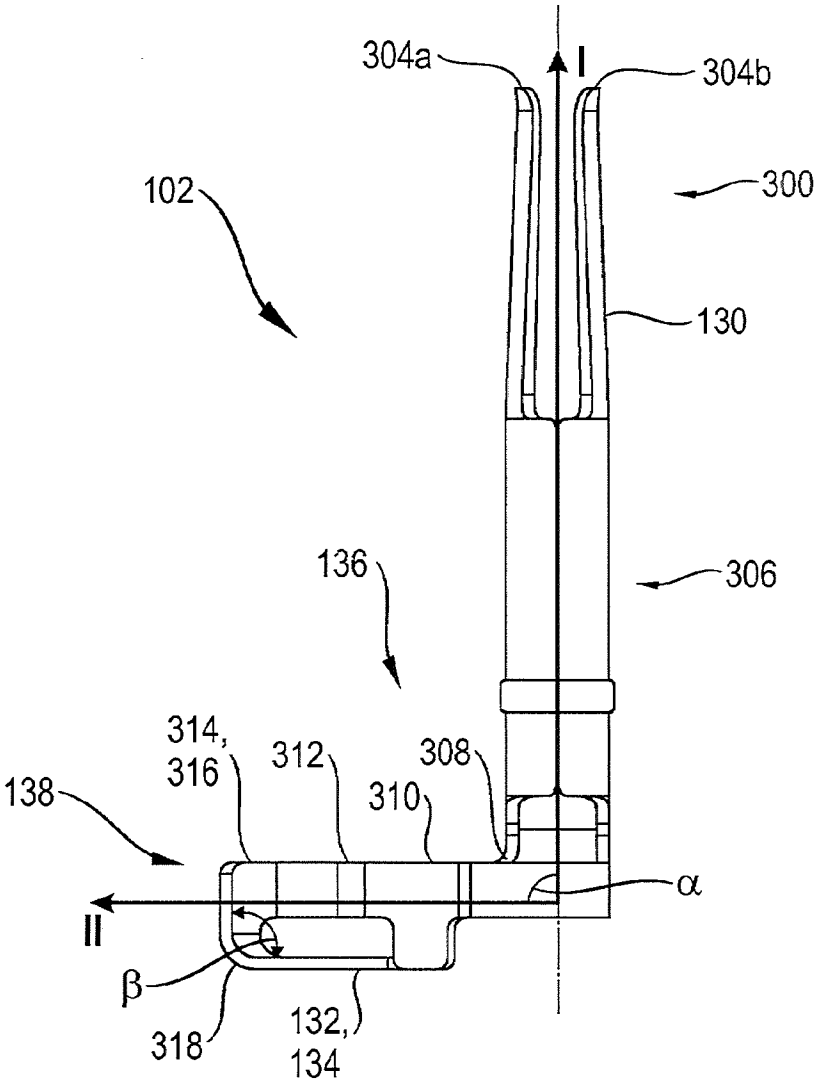
FIG. 4 shows a side view of the contact pin.
Figure 5:
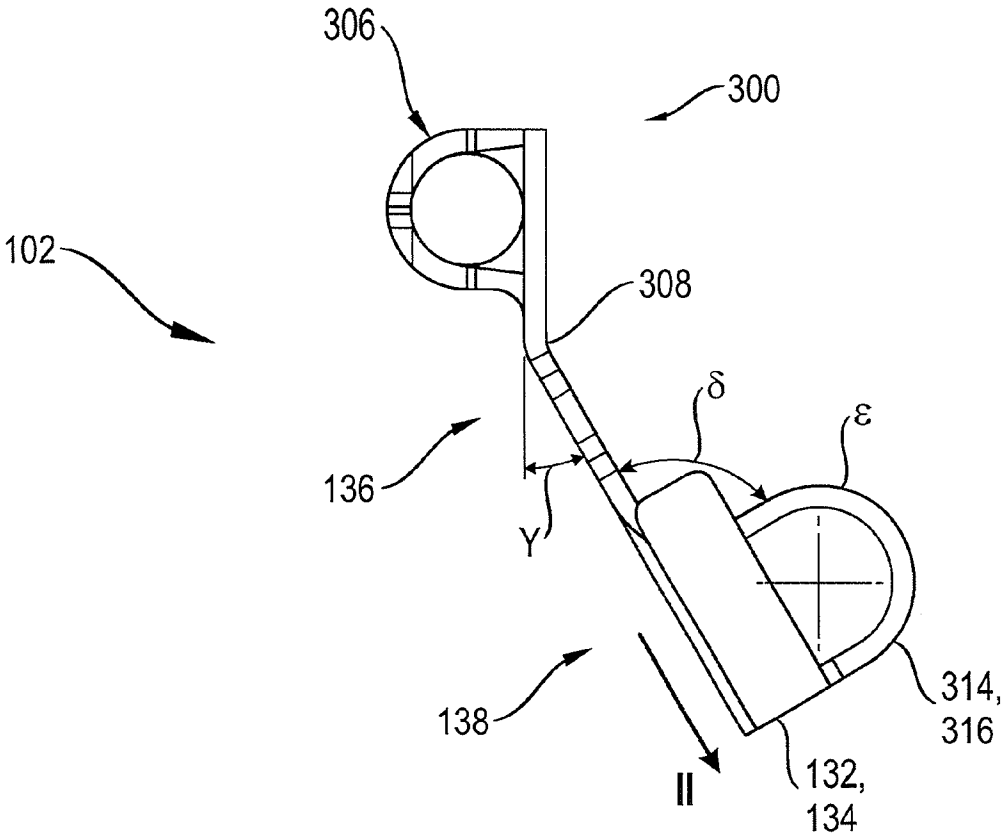
FIG. 5 shows a bottom view of the contact pin.

FIGS. 3 to 5 show the contact pin 102.

The contact pin 102 has a first end 300 at which the electrical contact 128 is arranged. In the present exemplary embodiment, the electrical contact 128 is configured as a contact socket 130 and, to this end, has two contact tongues 304*a*, 304*b* which are situated opposite each other and which are prestressed in a resilient manner in the positions illustrated in FIGS. 3 and 4 and can be elastically deformed by inserting a pin contact and which then firmly hold said contact by spring force. The contact pin 102 further has a channel 306 for receiving a pin contact of this kind.

The insertion movement of a pin contact into the contact socket 130 which is formed by the contact tongues 304*a*, 304*b* and into the channel 306 extends in a first direction I in which the contact pin 102 extends.

In the present exemplary embodiment, the contact arm 136 of the contact pin 102 extends in a second direction II. In the present exemplary embodiment, the second direction II extends at an angle $\alpha$ of 90° in relation to the first direction I (see FIGS. 3 and 4).

In the present exemplary embodiment, the contact arm 136 comprises a bend 308, a connecting portion 310 which adjoins the bend 308, and also an arc portion 312.

In the present exemplary embodiment, the bend 308 forms an angle $\gamma$ of 30°, while the arc portion 312 forms an angle $\delta$ of 90° in the present exemplary embodiment (see FIG. 5). Thereby, both the bend 308 and also the arc portion 312 are bent about an axis which runs parallel to the first direction I in the present exemplary embodiment.

In the present exemplary embodiment, the tolerance-compensating portion 138 is arranged between the contact arm 136 and the contact base 132 which is configured as a solder pad base 134.

In the present exemplary embodiment, the tolerance-compensating portion 138 comprises a bent arc 314 which, in the present exemplary embodiment, is configured as a U-shaped bend 316, and also comprises an angled portion 318.

Thereby, the U-shaped bend 316 is bent about an axis which extends parallel to the first direction I in the present exemplary embodiment. Furthermore, the U-shaped bend 316 is configured as an angle $\epsilon$ of 180° in the present exemplary embodiment (see FIG. 5).

In the present exemplary embodiment, the angled portion 318 however is bent at an angle $\beta$ of 90°, wherein the axis about which the angled portion 318 is bent extends both at a right angle to the first direction I and at a right angle to the second direction II (see FIG. 4). Therefore, in the present exemplary embodiment, the contact base 132 which adjoins the angled portion 318 has a direction of extent which lies in the direction of the second direction II. Therefore, the contact base 132 can be moved by up to 0.5 mm in all three directions in space in relation to the electrical contact 128.

Furthermore, FIGS. 3 to 5 show that, in the present exemplary embodiment, the contact base 132 is arranged below the tolerance-compensating portion 138 in the first direction I. Therefore, the electrical contact 128 and the contact base 132 are situated at opposite ends, specifically the first end 300 and the second end 302 of the contact pin 102, in the present exemplary embodiment.

Figure 6:
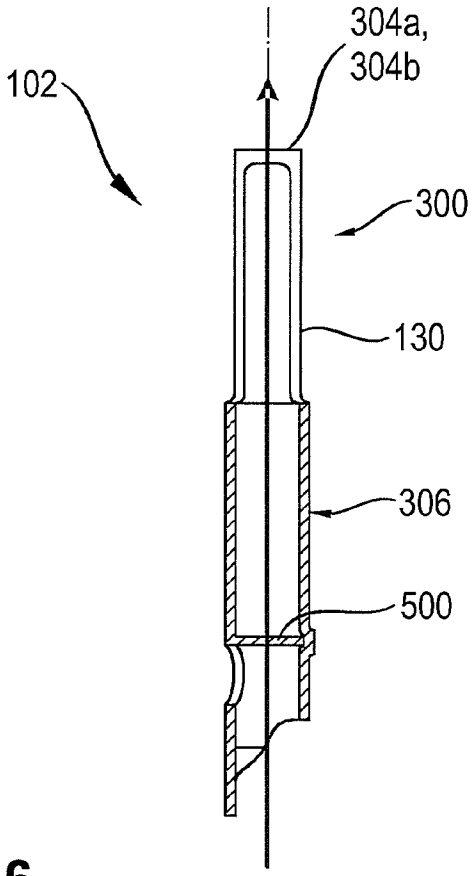
FIG. 6 shows a section through a portion of the contact pin.

FIG. 6 shows a section through the first end 300 of the contact pin 102. It can be seen that the contact pin 102 is of hollow configuration below the contact tongues 304*a*, 304*b* and therefore has the channel 306. In the present exemplary embodiment, the channel 306 is closed by an encapsulation compound barrier 500, such that no encapsulation compound, such as adhesive for example, can enter the channel 306 during an assembly process for example. In the present exemplary embodiment, the encapsulation compound barrier 500 is formed from a sheet metal portion of the contact pin 102 which has been stamped out and is folded to form the channel 306.

Figure 7:
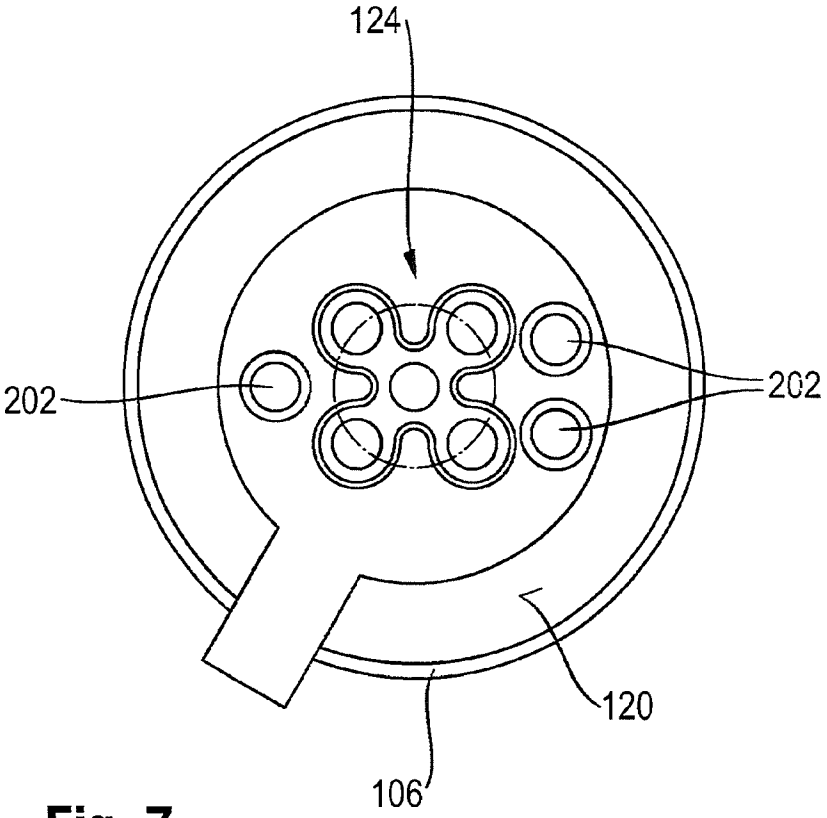
FIG. 7 shows a view of the top face of the bottom part.

FIG. 7 shows the top face of the bottom part 106. It can be seen that, in the present exemplary embodiment, the top face 120 has the positioning holes 202 in addition to the, in the present exemplary embodiment, five passage openings 124 in order to hold in each case one contact pin 102.

Figure 8:
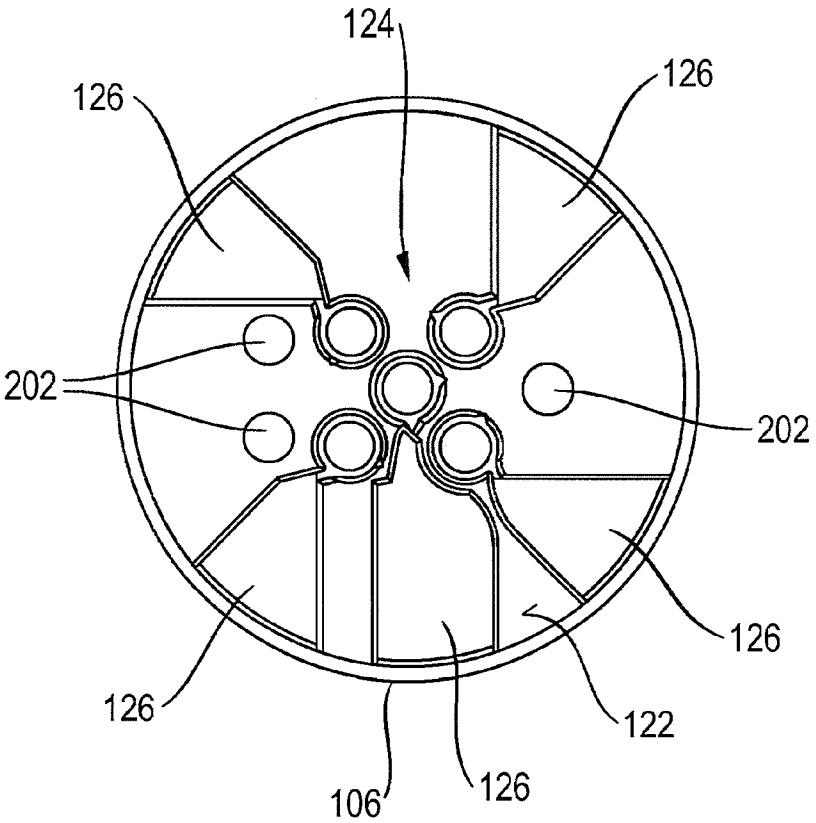
FIG. 8 shows a view of the bottom face of the bottom part.

FIG. 8 shows the bottom face 122 of the bottom part 106. It can bee seen that, in the present exemplary embodiment, five recesses 126 are provided in addition to the positioning holes 202 and the passage openings 124, into which the contact arm 136 of a contact pin 102 which is inserted into the passage opening 124 can be mounted.

LIST OF REFERENCE SYMBOLS

100 Contact carrier
102 Contact pin
104 Insulating sleeve
106 Bottom part
108 Union nut
110 Internal thread
112 Internal seal
114 External seal
116 Passage channel
118 Coding
120 Top face
122 Bottom face
124 Passage opening
126 Recess
128 Electrical contact
130 Contact socket
132 Contact base
134 Solder pad base
136 Contact arm
138 Tolerance-compensating portion
200 Positioning peg
202 Positioning hole
300 First end
302 Second end
304*a* Contact tongue
304*b* Contact tongue
306 Channel
308 Bend
310 Connecting portion
312 Arc portion
314 Bent arc
316 U-shaped bend
318 Angled portion
500 Encapsulation compound barrier
$\alpha$ Angle
$\beta$ Angle
$\gamma$ Angle δ Angle
ϵ Angle
X X direction
Y Y direction
Z Z direction
I First direction
II Second direction

The invention claimed is:

1. A contact carrier, comprising:

an electrical contact;

a contact arm which is electrically conductively connected to the electrical contact, wherein the contact arm includes a tolerance-compensating portion and a contact base, which is formed on the tolerance-compensating portion, for electrically contacting the electrical contact with a contact surface; and a bottom part in which the electrical contact is held, the bottom part including a radial recess for receiving the contact arm.

2. The contact carrier as claimed in claim 1, wherein the contact arm extends laterally or radially from the electrical contact.

3. The contact carrier as claimed in claim 2, wherein the electrical contact extends in a first direction, and the contact arm extends in a second direction, wherein the first direction and the second direction are arranged at an angle of 90°, within an angle tolerance range.

4. The contact carrier as claimed in claim 3, wherein the contact base extends in the second direction within an angle tolerance range.

5. The contact carrier as claimed in claim 1, wherein the tolerance-compensating portion is mechanically deformable.

6. The contact carrier as claimed in claim 1, wherein the tolerance-compensating portion is elastically or plastically deformable.

7. The contact carrier as claimed in claim 1, wherein the contact base is connected to the electrical contact by the tolerance-compensating portion.

8. The contact carrier as claimed in claim 1, wherein the tolerance-compensating portion comprises a bent arc, formed as a U-shaped bend.

9. The contact carrier as claimed in claim 1, wherein the contact base is arranged on the tolerance-compensating portion in a manner angled at an angle (β).

10. The contact carrier as claimed in claim 1, wherein the contact base is arranged below the tolerance-compensating portion.

11. The contact carrier as claimed in claim 1, wherein the contact base is formed on the tolerance-compensating portion in an elastically or plastically deformable manner.

12. The contact carrier as claimed in claim 1, wherein the contact base is a solder pad base.

13. The contact carrier as claimed in claim 1, wherein the electrical contact is a contact socket or a contact plug.

14. The contact carrier as claimed in claim 1, wherein the contact carrier has a removable insulating sleeve which is placed on the electrical contact.

15. The contact carrier as claimed in claim 1, wherein the contact carrier has a plurality of electrical contacts which are each electrically conductively connected to a contact.

16. The contact carrier as claimed in claim 1, wherein the contact carrier is an SMD contact carrier.

17. The contact carrier as claimed in claim 4, wherein the tolerance-compensating portion is mechanically deformable.

18. The contact carrier as claimed in claim 4, wherein the tolerance-compensating portion is elastically or plastically deformable.

* * * * *